US005113942A

United States Patent [19]

McMechan

[11] Patent Number: 5,113,942

[45] Date of Patent: May 19, 1992

[54] METHOD OF OPENING CASED WELL PERFORATIONS

[75] Inventor: David E. McMechan, Marlow, Okla.

[73] Assignee: Halliburton Company, Duncan, Okla.

[21] Appl. No.: 664,708

[22] Filed: Mar. 5, 1991

[51] Int. Cl.[5] ..... E21B 33/3; E21B 43/12; E21B 47/06

[52] U.S. Cl. ..... 166/250; 166/284

[58] Field of Search ..... 166/250, 255, 281, 282, 166/283, 284, 297, 298, 312

[56] References Cited

U.S. PATENT DOCUMENTS

| | | | |
|---|---|---|---|
| 3,028,914 | 4/1962 | Flickinger | 166/284 |
| 3,086,587 | 4/1962 | Zandmer et al. | 166/284 |
| 3,482,633 | 12/1969 | Stipp et al. | 166/284 |
| 3,547,197 | 12/1970 | Chevalier | 166/284 |
| 4,047,569 | 9/1977 | Tagirov et al. | 166/308 |
| 4,372,380 | 2/1983 | Smith et al. | 166/250 |
| 4,421,167 | 12/1983 | Erbstoesser et al. | 166/284 X |
| 4,442,895 | 4/1984 | Lagus et al. | 166/250 |
| 4,453,595 | 6/1984 | Lagus et al. | 166/250 |
| 4,488,599 | 12/1984 | Graham et al. | 166/255 |
| 4,753,295 | 6/1988 | Gabriel et al. | 166/284 |
| 4,770,243 | 9/1988 | Fouillout et al. | 166/53 |
| 4,836,280 | 6/1989 | Soliman | 166/250 |
| 4,845,981 | 7/1989 | Pearson | 166/308 X |
| 4,848,461 | 7/1989 | Lee | 166/250 |

*Primary Examiner*—George A. Suchfield
*Attorney, Agent, or Firm*—Robert A. Kent

[57] ABSTRACT

The present invention provides a reliable, high efficiency perforation breakdown process. The inventive process, which utilizes a treating fluid and ball sealers, can be used in all types of wells. In the inventive breakdown process, the number of perforations existing downhole which have already been opened but have not yet been temporarily sealed is determined from observed wellhead pressures and/or wellhead pressure changes. A treating fluid flow rate is then established such that (i) the treating fluid will continue to flow through the already opened perforations which have not yet been sealed at a velocity which is at least as high as the minimum effective sealing velocity but (ii) maximum safe wellhead pressure will not be exceeded when one or more additional perforations is sealed.

9 Claims, No Drawings

METHOD OF OPENING CASED WELL PERFORATIONS

BACKGROUND OF THE INVENTION

1. Field of the Invention

The present invention relates to methods of opening cased well perforations to fluid flow using a treating fluid and perforation sealers.

2. Description of the Prior Art

To protect against collapse and to facilitate various downhole processes, a well (e.g., an oil well, a gas well, an injection well, a water well, etc.) is usually cased. Typically, the casing is cemented in place and extends through one or more producing underground formations. In order to place the cased well in fluid communication with producing formations, the casing must be perforated. Casings can be perforated with round holes using jet perforators, bullet perforators, or other equipment used in the art. Depending upon the diameter of the holes and the size of the casing, a vertical foot of casing can be perforated with up to 30+ holes.

After the casing perforations have been formed, the well is typically subjected to a breakdown treatment in order to open the perforations to fluid flow. In the breakdown treatment, a treating fluid is pumped into the well under high pressure. Typically, the treating fluid is pumped into the well through a string of tubing positioned inside the casing. The high pressure treating fluid breaks down (i.e., opens up) the casing perforations. The treating fluid then flows through the broken down perforations and into the formation.

Depending on the type of well (e.g., oil, gas, injection, water, etc.) being treated, various types of breakdown fluids are commonly used in the art. Examples include water, brine, oil, foams, emulsions, and like fluids. Additives such as acids, viscosifiers, surfactants, breakers, biocides, fluid loss agents, and the like can be added to the treating fluid in order to enhance the effectiveness of the breakdown treatment.

In order to increase the number of perforations which are successfully broken down during a breakdown treatment, perforation sealers are placed in the treating fluid. In a given formation, the breakdown pressures of the individual perforations can vary substantially. Some perforations break down at a relatively low pressure while other perforations will not break down unless the pressure is much higher. At a constant treating fluid flow rate, perforation sealers operate to increase the treatment pressure by temporarily sealing off perforations which have already broken down. If a constant treating fluid flow rate is maintained, the sealing of one or more of these open perforations forces a greater amount of treating fluid to flow through the broken down perforations which have not yet been sealed. Thus, the pressure within the casing rises as each broken down perforation is sealed.

Typically, the perforation sealers used in breakdown treatments are spherically-shaped, have a diameter slightly greater than the diameter of the casing perforations, and are slightly heavier (i.e., more dense) than the particular treating fluid being used. Ball sealers are generally available in sizes ranging in diameter from about $\frac{5}{8}$ inch to about $1\frac{1}{4}$ inches. Casing perforations, on the other hand, are commonly formed in sizes ranging in diameter from about $\frac{3}{8}$ inch to about $\frac{7}{8}$ inch. Ball sealers typically have a core composed of a resinous material such as nylon, syntactic foam, or like material and a deformable cover composed of a plastic, an elastomer, rubber, or like material. Perfpac Balls sold by Halliburton Services are particularly well suited for use in breakdown treatments. Perfpac Balls are described, for example, in Data Sheet F-3242 entitled "Halliburton Services-Fracturing Technical Data: Perfpac Balls" published by Halliburton Services, Duncan, Oklahoma 73536, the entire disclosure of which is incorporated herein by reference.

Breakdown treatments are commonly performed using a constant treating fluid flow rate. When a constant treating fluid flow rate is used, a sudden significant decrease in well pressure indicates that at least one additional perforation has broken down. A sudden significant increase in well pressure, on the other hand, indicates that at least one of the broken down perforations has been successfully sealed. Thus, the progress of a constant flow breakdown treatment can be monitored by simply observing the pressure changes which occur at the wellhead (i.e., at the surface entrance to the well).

Although constant flow breakdown treating methods allow simplified monitoring, constant flow breakdown treatments typically must be ended well before all of the broken down perforations have been sealed. As explained hereinabove, when a constant flow rate treatment is used, the pressure in the well casing increases each time a broken down perforation is successfully sealed. These pressure increases promote the breakdown of additional perforations. However, due to large frictional pressure losses in the well tubing, the pressure at the wellhead usually reaches the maximum safe wellhead pressure (MSWHP) before all of the broken down perforations have been sealed. When this point is reached, the sealing of one additional perforation will cause the wellhead pressure to exceed MSWHP. Thus, the treatment must be ended.

Unless substantially all of the broken down perforations have been sealed, optimum breakdown conditions cannot be achieved downhole (i.e., in the perforated zone) and, therefore, many high breakdown pressure perforations will not be opened up. Optimum breakdown conditions exist downhole when the wellhead pressure reaches MSWHP and the tubing frictional pressure loss is essentially zero. If some of the broken down perforations remain unsealed, however, a substantial amount of the high pressure treating fluid continues to flow through the well tubing and out of the unsealed perforations. Thus, the tubing frictional pressure loss remains quite high.

Although some in the art reduced the treating fluid flow rate when the wellhead pressure approaches MSWHP, this technique can also leave many perforations unopened. Since ball sealing efficiency is directly related to the velocity at which the treating fluid flows through the broken down perforations, inadequate perforation sealing can occur when the treating fluid flow rate is reduced. Additionally, even though the flow rate has been reduced, the treatment might still be ended before all of the existing broken down perforations have been sealed. Depending on the number of unsealed perforations and/or poorly sealed perforations existing at the end of the treatment, a substantial amount of the high pressure treating fluid can continue to flow through the well tubing and into the formation. Thus, due to a resulting inability to minimize frictional pressure loss in the well tubing, optimum treating conditions cannot be achieved downhole.

Therefore, a need exists for a reliable, high efficiency breakdown method which overcomes the problems discussed above.

SUMMARY OF THE INVENTION

The present invention provides a method of opening casing perforations using a treating fluid and perforation sealers. The inventive method comprises the steps of: (a) determining the number of perforations in the well which have already been opened but have not yet been sealed and (b) establishing a treating fluid flow rate. The treating fluid flow rate is such that (a) the treating fluid flows through the already opened perforations which have not yet been sealed at a velocity which is at least as high as the minimum effective sealing velocity but (b) the maximum safe wellhead pressure will not be exceeded when the next of the already opened perforations is sealed.

The inventive method can generally be used in breakdown treatments on all types of wells. Additionally, the inventive method can generally be used in conjunction with any of the breakdown treatment fluid systems normally used in the art.

The inventive method provides a reliable, high efficiency breakdown treatment procedure which solves the prior art problems discussed hereinabove and provides optimum downhole treating conditions. Through the use of effective breakdown treatment monitoring procedures and proper treating fluid flow rate adjustments, the inventive method ensures that all of the broken down perforations have been sealed before the treatment is ended. Additionally, since the breakdown treating fluid always flows through the existing unsealed perforations at a velocity which is at least as high as the minimum effective sealing velocity, high sealing efficiency is maintained throughout the breakdown treatment. Further, the inventive method ensures that, until the last perforation is sealed, the sealing of additional perforations will not cause the wellhead pressure to exceed MSWHP.

Further objects, features, and advantages of the present invention will readily appear to those skilled in the art upon reading the following description of the preferred embodiments.

DESCRIPTION OF THE PREFERRED EMBODIMENTS

The present invention provides a reliable, high efficiency breakdown treatment process which can be used in all types of cased wells. In the preferred embodiment of the inventive process, surface pressure changes at the wellhead are used to determine the current number of unplugged perforations (i.e., perforations which have broken down but have not yet been sealed) currently existing downhole (i.e., in the perforated zone). Once the number of unplugged perforations has been determined, projections are made for the wellhead pressure changes which will occur at the current flow rate when additional perforations are broken down and/or sealed. Using these projections, the number of unplugged perforations existing in the formation can be continually updated by monitoring the pressure changes which occur at the wellhead. The pressure change projections will also indicate the point in the breakdown treatment at which, given the current treating fluid flow rate, the sealing of one additional perforation will cause the wellhead pressure to exceed MSWHP. Before this point is reached, the treating fluid flow rate is reduced. The new treating fluid flow rate will be such that, when the new rate is implemented, (a) MSWHP will not be exceeded when at least one additional unplugged perforation is sealed and (b) the treating fluid will continue to flow through the unplugged perforations at a velocity which is at least as high as the minimum effective sealing velocity.

At any point during the breakdown treatment, the pressure existing at the wellhead ($P_{WH}$) will be determined as follows:

$$P_{WH}=BHTP-H+P_{PF}+P_T \quad (1)$$

wherein BHTP (i.e. bottom hole treating pressure) is the pressure existing in the formation immediately outside of the casing perforations; H is the hydrostatic head produced by the column of treating fluid extending vertically from the perforated zone to the wellhead; $P_{PF}$ is the absolute value of the frictional pressure loss resulting from the flow of treating fluid through the unplugged perforation(s); and $P_T$ is the absolute value of the frictional pressure loss resulting from the flow of treating fluid through the well tubing. Typically, only $P_{WH}$ is measured directly during a breakdown treatment. Values for H and $P_T$ can be calculated using well known formulas for the determination of head and frictional pressure loss. BHTP values are typically obtained by multiplying the well depth (feet) by an estimated frac gradient (psi/ft). As is known in the art, the frac gradient for a particular formation can be estimated from data obtained in fracturing operations performed in the same and/or similar formations.

Given an observed value for $P_{WH}$, an estimated value for BHTP, and calculated values for H and $P_T$, the value of $P_{PF}$ can be determined using equation (1). However, due to uncertainties inherent in the estimation of BHTP and the calculation of $P_T$, reliable values for $P_{PF}$ typically cannot be obtained solely through the use of equation (1).

If the number of unplugged perforations currently existing downhole is known, $P_{PF}$ can be calculated using the formula:

$$P_{PF}=\frac{0.2369Q^2\rho}{N^2D^4C^2} \quad (2)$$

wherein Q is the total treating fluid flow rate in barrels per minute; $\rho$ is the treating fluid density expressed in lb/gal; N is the number of unplugged perforations currently existing downhole; D is the perforation diameter in inches; and C is a dimensionless, empirically derived, perforation discharge coefficient. The appropriate value of C for a given application can be determined using various charts and/or tables which are readily available to those skilled in the art.

When constant treating conditions (i.e., constant treating fluid flow rate, composition and temperature) are maintained, the amount by which the actual value of $P_{PF}$ changes when an additional perforation is broken down or sealed will be directly indicated by an equivalent change in the observed value of $P_{WH}$. Although the values of BHTP and $P_T$ cannot be determined with a high degree of reliability, significant sudden changes in the actual values of BHTP and $P_T$ will not occur as long as constant treating conditions are maintained. Further, the actual value of H will not change significantly as long as the treating fluid composition and temperature remain unchanged.

Since, at constant treating conditions, the amount by which $P_{PF}$ changes when an additional perforation is broken down or sealed can be directly measured at the wellhead, the number of unplugged perforations existing downhole at a given point during the breakdown treatment can be reliably determined using equation (2). For example, at a given point in the breakdown treatment, $P_{PF}=P_{PF1}$ (unknown), $N=N_1$ (unknown), $P_{WH}=P_{WH1}$ (observed), and Q, $\rho$, D, and C are known. If one additional perforation is sealed and constant treating conditions are maintained: Q, $\rho$, D, and C will be unchanged, $P_{WH}$ will have an observed value of $P_{WH2}$, $P_{PF}$ will have a value of $P_{PF2}$ (unknown), and N will have a value of $N_1-1$ (unknown). However, since $P_{PF2}-P_{PF1}=P_{WH2}-P_{WH1}$, $N_1$ and $N_1-1$ can readily be determined using equation (2).

Once the current number of unplugged perforations existing downhole has been determined, equation (2) can then be used to project the step-wise wellhead pressure increases and decreases which will result from the subsequent breakdown and/or sealing of additional perforations. Thus, by simply monitoring the wellhead pressure and pressure changes which occur as additional perforations are broken down and/or sealed, an operator can keep track of the number of unplugged perforations currently existing downhole and determine the number of additional unplugged perforations which can be sealed at the current treating fluid flow rate without causing the wellhead pressure to exceed MSWHP.

Having determined the number of currently existing unplugged perforations, the operator can also use equations (1) and (2) to determine a new maximum flow rate. As indicated above, the maximum new treating fluid flow rate will be the maximum treating fluid flow rate which can be implemented, assuming that no additional perforations are broken down, without causing $P_{WH}$ to exceed MSWHP when at least one additional perforation is sealed. Alternatively, given a selected new treating fluid flow rate, the operator can use equations (1) and (2) to determine the number of additional perforations which can be sealed at the selected flow rate, assuming that no additional perforations are broken down, without causing $P_{WH}$ to exceed MSWHP.

Knowing the number of currently existing unplugged perforations, the operator can also determine the minimum new flow rate which must be maintained in order to ensure that the remaining unplugged perforations are well sealed. The minimum new treating fluid flow rate can readily be determined from (a) the minimum sealing velocity (i.e., the minimum velocity of treating fluid through the unplugged perforations which must be maintained in order to ensure a desired percentage reduction in perforation flow capacity), (b) the diameter of the perforations, and (c) the number of unplugged perforations which will exist downhole when the new treating fluid flow rate is established.

If, due to the sudden breakdown of a substantial number of additional perforations, the perforation flow velocity is reduced to a point close to or below the minimum effective sealing velocity, the inventive process can also be used to implement an appropriate treating fluid flow rate increase. The increased treating fluid flow rate will be calculated using the same procedures described above and must be such that, when the increased flow rate is implemented, (a) MSWHP will not be exceeded when at least one additional perforation is sealed and (b) the treating fluid will flow through the unplugged perforations existing downhole at a velocity which is at least as high as the minimum effective sealing velocity.

Several factors influence the degree of sealing efficiency achieved during a breakdown treatment. These include: (a) the rate at which the treating fluid flows through the perforations; (b) the casing size; (c) the degree of density difference between the treating fluid and the perforation sealers; (d) the amount of treating fluid which flows past a perforation rather than through the perforation; (e) the viscosity of the treating fluid; (f) the diameter of the perforations; and (g) the diameter of the ball sealers. Generally, sealing efficiency increases with increased flow rate through the perforations and increased fluid viscosity. Sealing efficiency generally decreases with increased flow past the perforation, increased casing size, increased density difference between the fluid and the ball sealers, and increased diameter difference between the ball sealers and the perforations. The primary factors affecting sealing efficiency are the velocity at which the treating fluid flows through the perforations and the casing size.

As used herein, the term "minimum effective sealing velocity" refers to the minimum velocity of treating fluid through the unplugged perforations which must be maintained in order to guarantee that a desired percentage reduction in perforation flow capacity (i.e., a desired sealing efficiency) will be achieved. Minimum effective sealing velocities for a wide variety of treating conditions have been determined experimentally. Most of the velocity charts and tables commonly used in the art provide minimum effective flow velocities suitable for achieving a sealing efficiency of at least about 80%. However, minimum effective velocity charts and tables for achieving other degrees of sealing efficiency are also readily available to those skilled in the art. The minimum fluid velocity suggested for achieving a desired sealing efficiency in a specific application will usually depend upon the casing size/ball density/fluid density combination being used. Velocity charts are typically prepared using routine, repetitive laboratory tests wherein fluids of varying density, viscosity, etc. are caused to flow through and past perforations which have been formed in casings of varying size.

The calculations used in the inventive process can be performed during the breakdown treatment. If a computer is used for performing real-time calculations, more accurate wellhead pressure change projections can be obtained by continually updating certain equation parameters. For example, the wellhead pressure changes which are projected to result from the breakdown or sealing of additional perforations can be compared to the wellhead pressure changes which actually occur. Based on this comparison, the diameter/discharge coefficient product term of equation (2) can be updated in order to improve the accuracy of subsequent calculations.

Alternatively, at least some of the projections used in the inventive method can be made prior to the breakdown treatment. As illustrated in the examples provided hereinbelow, tables can be prepared which provide projected $P_{WH}$ values and/or $P_{WH}$ value changes for a range of assumed values of N (i.e., the number of unplugged perforations) and a range of treating fluid flow rates (Q). Based on the wellhead pressures and/or pressure changes observed during the breakdown treatment, these tables can be used to: determine the number of unplugged perforations currently existing downhole; monitor the progress of the breakdown treatment; determine when flow rate changes will be necessary; and determine new treating fluid flow rates which will meet the requirements of the inventive process.

During the breakdown treatment, the perforation sealers should be released into the treating fluid at a frequency which provides sufficient time for performance of the steps required by the inventive process. These steps include: the measurement of wellhead pressure; determination of the need for a change in treating fluid flow rate; determination of a suitable new treating fluid flow rate; and adjustment of the treating fluid flow rate. The time required for performing these tasks can vary considerably depending on the type of equipment used to monitor and control the process and evaluate the process data.

The inventive breakdown process is preferably used in conjunction with perforating techniques which provide round, burr-free perforations of consistent size. These perforation characteristics contribute to the achievement of good ball sealing efficiency. These perforation characteristics also enhance the reliability of all equation (2) determinations and projections. Uniform, round, burr-free perforations can be obtained, for example, using burr-free-type cased carrier charges.

Using the inventive process, optimum downhole treatment pressures can be achieved without causing the wellhead pressure to exceed MSWHP. During the inventive process, wellhead pressure is always maintained at or below MSWHP. However, since the inventive process ensures that all of the unplugged perforations will be efficiently sealed, the frictional loss in the well tubing at the end of the breakdown treatment (i.e., after all of the unplugged perforations have been sealed) will be minimal. Additionally, the inventive process provides sufficient warning that the sealing of the final unplugged perforation is about to occur. Thus, when the final unplugged perforation is sealed, the treating pumps can be stopped at a point such that $P_{WH}$ is substantially equal to (i.e., equal to or slightly less than) MSWHP. At this point, since $P_{WH}$ is substantially equal to MSWHP and $P_T$ is minimal, the maximum attainable downhole treating pressure is achieved.

The following example further illustrates the inventive process.

EXAMPLE

Thirty 0.3 inch diameter perforations are made in a 5.5 inch diameter well casing at a depth of 10,000 feet. Well tubing having a diameter of $2\frac{7}{8}$ inches extends through the casing from the surface to a depth of 9,500 feet. Maximum safe wellhead pressure (MSWHP) is 7,000 psi. Due to an estimated frac gradient of 0.75 psi/ft, the well has an estimated bottom hole treating pressure (BHTP) of 7,500 psi.

A water-based treating fluid is used to break down the perforations. The treating fluid contains 2 weight percent KCl. The treating fluid also contains ten pounds of hydroxypropylguar (HPG) friction reducer per 1,000 gallons of treating fluid. The ball sealers used in the breakdown treatment are $\frac{7}{8}$-inch rubber coated nylon (RCN) ball sealers having a specific gravity of 1.3.

Tables I, II, and III provide projected wellhead pressure values for treating fluid flow rates (Q) of 10 BPM, 5 BPM, and 2 BPM respectively. The values provided in Tables I, II, and III are obtained from equations (1) and (2) based on a fluid density ($\rho$) of 8.4 lb/gal, a perforation discharge coefficient (C) of 0.6, and a calculated hydrostatic head (H) of 4,400 psi. The calculated tubing frictional pressure losses ($P_T$) at 10, 5 and 2 BPM are 1,350 psi, 520 psi, and 150 psi, respectively.

TABLE I

| Number of unplugged perforations | Well Treatment Projections Based on Treating Fluid Flow of 10 BPM | | |
|---|---|---|---|
| | $P_{PF}$ (psi) | $P_{WH}$ (psi) | $P_{WH}$ increase when previous hole sealed (psi) |
| 11 | 563 | 5,013 | 89 |
| 10 | 682 | 5,132 | 119 |
| 9 | 842 | 5,292 | 160 |
| 8 | 1,066 | 5,516 | 224 |
| 7 | 1,392 | 5,842 | 326 |
| 6 | 1,895 | 6,345 | 503 |
| 5 | 2,729 | 7,180 | 835 |
| 4 | 4,265 | 8,715 | 1,535 |
| 3 | 7,582 | 12,032 | 3,317 |

TABLE II

| Number of unplugged perforations | Well Treatment Projections Based on Treating Fluid Flow of 5 BPM | | |
|---|---|---|---|
| | $P_{PF}$ (psi) | $P_{WH}$ (psi) | $P_{WH}$ increase when previous hole sealed (psi) |
| 7 | 348 | 3,970 | |
| 6 | 474 | 4,096 | 126 |
| 5 | 682 | 4,304 | 178 |
| 4 | 1,066 | 4,688 | 384 |
| 3 | 1,896 | 5,518 | 830 |
| 2 | 4,265 | 7,887 | 2,369 |
| 1 | 17,061 | 20,683 | 12,796 |

TABLE III

| Number of unplugged perforations | Well Treatment Projections Based on Treating Fluid Flow of 2 BPM | | |
|---|---|---|---|
| | $P_{PF}$ (psi) | $P_{WH}$ (psi) | $P_{WH}$ increase when previous hole sealed (psi) |
| 4 | 171 | 3,421 | 60 |
| 3 | 303 | 3,553 | 132 |
| 2 | 682 | 3,932 | 379 |
| 1 | 2,730 | 5,980 | 2,048 |

The breakdown treatment is begun at a treating fluid flow rate of 10 BPM. As the treatment proceeds, a sudden wellhead pressure ($P_{WH}$) increase of about 89 psi is observed. As shown in Table I, a $P_{WH}$ increase of about 89 psi indicates that 11 unplugged perforations currently exist downhole. As further indicated in Table I, when only 6 unplugged perforations remain downhole, the sealing of 1 additional unplugged perforation, assuming that no additional perforations are broken down, will cause $P_{WH}$ to exceed MSWHP. However, if the treatment is stopped when only 6 unplugged perforations remain, the downhole pressure will still be about 2,005 psi less than would be realized if $P_{WH}$=MSWHP and $P_T$=0. Thus, at some point before only 5 unplugged perforations exist downhole, a suitable reduced treating fluid flow rate should be established.

Given the casing size, ball density, and fluid density parameters of the breakdown treatment, it is determined from appropriate treatment charts that a flow rate of at least 17 gal/min must be maintained through each unplugged perforation in order to ensure a continued sealing efficiency of at least 80%. Thus, the minimum flow which could be used when only 6 unplugged perforations remain is 2.86 BPM. Table II shows that, if the treating fluid flow rate is reduced to 5 BPM, $P_{WH}$ will not exceed MSWHP until only 2 unplugged perforations remain. Consequently, the treating fluid flow rate is reduced from 10 BPM to 5 BPM when the observed wellhead pressure increases indicate that the number of unplugged perforations existing downhole has been reduced to only 6.

Similarly, it is determined that the treating fluid flow rate can be reduced from 5 BPM to 2 BPM when the number of unplugged perforations existing downhole has been reduced to only 3. At 2 BPM, the treating fluid flow rate through each of the 3 remaining unplugged perforations will be 28 GPM. Further, at 2 BPM, $P_{WH}$ cannot exceed MSWHP until all of the unplugged perforations have been sealed.

After the treating fluid flow rate is reduced to 2 BPM, $P_{WH}$ is closely monitored so that the treating pumps can be safely stopped after the final unplugged perforation is sealed. The pumps are stopped just before $P_{WH}$ exceeds MSWHP. Since, at this point, $P_{WH}$ is substantially equal to MSWHP and the tubing frictional loss ($P_T$) is minimal, the maximum obtainable downhole treating pressure has been achieved.

Thus, the present invention is well adapted to carry out the objects and obtain the ends and advantages mentioned above as well as those inherent therein. While presently preferred embodiments have been described for purposes of this disclosure, numerous changes will be apparent to those skilled in the art. Such changes are encompassed within the spirit of this invention as defined by the appended claims.

What is claimed is:

1. A method of opening perforations in a cased well to fluid flow, said cased well having a maximum safe wellhead pressure, using a treating fluid and perforation sealers, comprising the steps of:

(a) determining the number of perforations in said cased well which have already been opened by injection of said treating fluid into said well but have not yet been sealed; and (b) establishing a treating fluid flow rate such that (i) said treating fluid flows through said already opened perforations which have not yet been sealed determined in step (a) at a velocity which is at least as high as the minimum effective sealing velocity but (ii) said maximum safe well head pressure will not be exceeded when the next of said already opened perforations which have not yet been sealed is sealed.

2. The method of claim 1 further comprising the step prior to step (b) of determining said treating fluid flow rate based on the number of said already opened perforations which have not yet been sealed determined in step (a).

3. The method of claim 2 wherein the number of said already open perforations which have not yet been sealed is determined from prior wellhead pressure changes.

4. A method of opening perforations in a cased well to fluid flow, said cased well having a maximum safe wellhead pressure, using a treating fluid and perforation sealers, comprising the steps of:

(a) determining, at a current treating fluid flow rate, the number of said perforations which have been opened by injection of said treating fluid and which must be sealed in order to cause the pressure at the well head of said cased well to exceed said maximum safe wellhead pressure; and (b) before said number of perforations determined in step (a) are sealed, establishing a new treating fluid flow rate such that (i) said treating fluid flows through the perforations in said cased well which have already been opened but have not yet been sealed at a velocity which is at least as high as the minimum effective sealing velocity but (ii) said maximum safe well head pressure will not be exceeded when the next of said already opened perforations is sealed.

5. The method of claim 4 further comprising the step prior to step (a) of determining the number said already opened perforations which have not yet been sealed.

6. The method of claim 5 wherein the number of said already opened perforations which have not yet been sealed determined in claim 5 is determined from prior wellhead pressure changes.

7. The method of claim 4 further comprising the step after step (b) of establishing a pressure at the wellhead of said cased well which is substantially equivalent to said maximum safe wellhead pressure.

8. A method of opening perforations in a cased well to fluid flow, said cased well having a maximum safe wellhead pressure, using a treating fluid and perforation sealers, comprising the steps of:

(a) determining, from prior pressure changes occurring at the wellhead of said cased well, the number of perforations in said cased well which have already been opened by injection of said treating fluid into said well but have not yet been sealed;

(b) determining, at a current treating fluid flow rate, the number of said already opened perforations which have not yet been sealed determined in step (a) which must be sealed in order to cause the pressure at the wellhead of said cased well to exceed said maximum safe wellhead pressure;

(c) determining a new treating fluid flow rate such that (i) said treating fluid will flow through said already opened perforations which have not yet been sealed at a velocity which is at least as high as the minimum effective sealing velocity but (ii) said maximum safe wellhead pressure will not be exceeded when the next of said already opened perforations is sealed; and (d) before said number of said already opened perforations determined in step (b) are sealed, establishing said new treating fluid flow rate determined in step (c).

9. The method of claim 8 further comprising the step of:

(e) after all of said already opened perforations have been sealed, establishing a pressure at the wellhead of said cased well which is substantially equivalent to said maximum safe wellhead pressure.

* * * * *